US005748570A

United States Patent [19]

Komoda

[11] Patent Number: 5,748,570

[45] Date of Patent: May 5, 1998

[54] TIME CORRECTION OF AN ELECTRONIC CLOCK

[75] Inventor: Motoyoshi Komoda, Tokyo, Japan

[73] Assignee: NEC Corporation, Tokyo, Japan

[21] Appl. No.: 786,256

[22] Filed: Jan. 22, 1997

Related U.S. Application Data

[63] Continuation of Ser. No. 443,309, May 17, 1995.

[30] Foreign Application Priority Data

May 20, 1994 [JP] Japan ..... 6-131130

[51] Int. Cl.[6] ..... G04G 3/02

[52] U.S. Cl. ..... 368/202; 368/10

[58] Field of Search ..... 368/200–202, 368/1–10

[56] References Cited

U.S. PATENT DOCUMENTS

| | | | |
|---|---|---|---|
| 4,024,416 | 5/1977 | Fujita et al. | 368/201 |
| 4,305,041 | 12/1981 | Frerking . | |
| 4,321,521 | 3/1982 | Ueda et al. | 368/11 |
| 5,195,063 | 3/1993 | Moriya | 368/85 |

FOREIGN PATENT DOCUMENTS

| | | | |
|---|---|---|---|
| 0511573A2 | 11/1992 | European Pat. Off. . | |
| 133083 | 6/1988 | Japan | 368/201 |
| 63-133083 | 6/1988 | Japan . | |
| 12084 | 1/1990 | Japan | 368/201 |

*Primary Examiner*—Bernard Roskoski
*Attorney, Agent, or Firm*—Whitham, Curtis & Whitham

[57] ABSTRACT

An electronic clock includes a usual oscillator and a more accurate oscillator. The usual oscillator generates a first frequency which causes the electronic clock to operate and the more accurate oscillator generates a second frequency which is used as a reference frequency. Referring to the second frequency, the first frequency is measured by a frequency measurement circuit and a deviation of the first frequency from a design frequency is calculated by a processor. According to the deviation, time correction of the electronic clock is performed. Therefore, even if an actual oscillation frequency of the usual oscillator is not stable precisely, the accurate time correction can be achieved.

21 Claims, 4 Drawing Sheets

TIME CORRECTION OF AN ELECTRONIC CLOCK

This is a Continuation of application Ser. No. 08/443,309 filed May 17, 1995.

BACKGROUND OF THE INVENTION

1. Field of the Invention

The present invention relates to an electronic clock, and more particularly to a time correction of the electronic clock for achieving high accuracy.

2. Description of the Related Art

Recently, portable radio telephones with various functions have become widely used and those including a clock function have been in common use particularly. The accuracy of such a clock is an important factor in the practical use of the portable telephone. Since an accurate electronic clock requires a precise oscillation frequency, a highly accurate quartz oscillator is employed in general which has a manufacturing deviation of approximately ±5 ppm. Alternatively, a usual quartz oscillator having an accuracy of approximately ±20–50 ppm is employed and the fine adjustment of the oscillation frequency thereof is performed by a trimmer capacitor or the like.

However, since there are variations in the load capacity of the oscillation circuit even when a highly accurate quartz oscillator is employed, it is not possible to actually obtain the high accuracy equivalent to that of the quartz oscillator. Therefore, there occurs such a problem that a highly accurate clock can not be obtained though much expensive devices are employed therein.

Further, when a quartz oscillator having a usual accuracy is used, the quartz oscillator itself is inexpensive but frequency adjusting devices such a trimmer capacitor are required, causing a drawback such that the cost of components increases and the frequency adjustment becomes troublesome. Especially, increase in the number of components leads to prevention of miniaturization of the portable equipment.

It is therefore an object of the present invention to provide an electronic clock with high accuracy which is realized with a simple construction.

It is another object of the present invention to provide a time correction method for automatically adjusting the time of the electronic clock.

SUMMARY OF THE INVENTION

In accordance with an aspect of the present invention, an electronic clock is comprised of two oscillators: a first oscillator generating a first frequency which causes the electronic clock to operate and a second oscillator generating a second frequency which is used as a reference frequency. Therefore, the second oscillator is more accurate in frequency than the first oscillator. Referring to the second frequency, a deviation of the first frequency from a predetermined frequency is calculated. The predetermined frequency is, for example, a design frequency which causes the electronic clock to work accurately. Time of the electronic clock is corrected on the basis of the deviation calculated. Therefore, even if an actual oscillation frequency of the first oscillator is varied, the accurate clock operation can be achieved by correcting the time of the electronic clock based on the deviation.

More specifically, the deviation is obtained by the following steps: measuring the first frequency using the second frequency as the reference frequency; and calculating the deviation using the first frequency and the predetermined frequency. The time correction is performed by using a correction time interval during which a predetermined time departure occurs. The time of the electronic clock is corrected by the predetermined time departure each time the correction time interval lapses.

In accordance with another aspect of the present invention, an electronic clock is further comprised of a memory storing the deviation data or the correction time interval data. Preferably, the memory is a non-volatile memory. Especially, when the electronic clock is incorporated in a portable radio apparatus, its power supply is sometimes turned off for energy-saving. However, the electronic clock according to the present invention can restart performing the accurate time correction using the deviation stored in the memory when the power supply is turned on.

BRIEF DESCRIPTION OF THE DRAWINGS

The novel features believed characteristics of the invention are set forth in the appended claims. The invention itself, however, as well as other features and advantages thereof, will be best understood by reference to the detailed description which follows, read in conjunction with the accompanying drawings, wherein:

DETAILED DESCRIPTION OF SPECIFIC EMBODIMENTS

Figure 1:
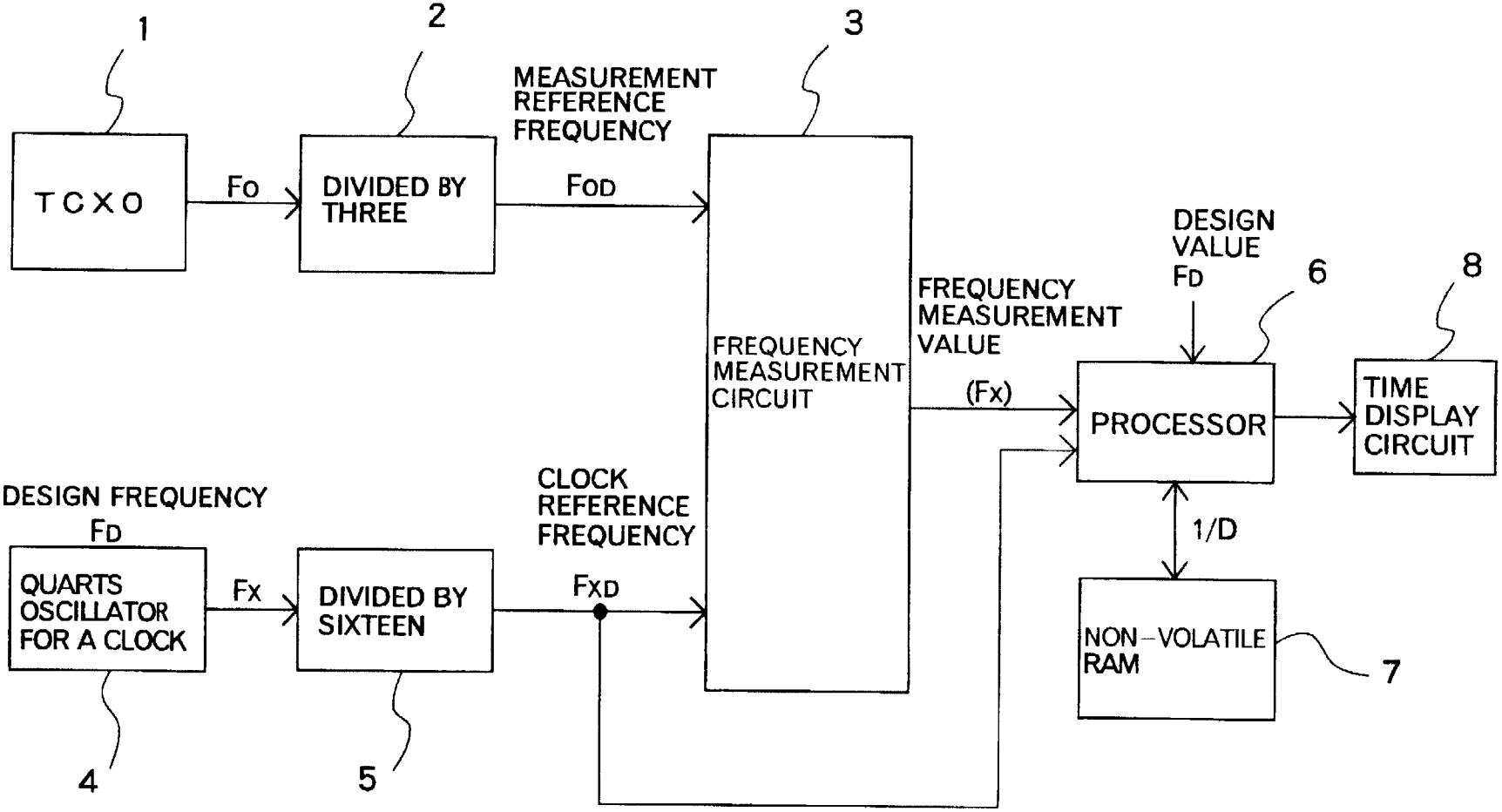
FIG. 1 is a schematic block diagram showing an embodiment of an electronic clock according to the present invention.

As illustrated in FIG. 1, a temperature compensated quartz oscillator (TCXO) 1 outputs an oscillation signal of a frequency Fo to a frequency divider 2 where the oscillation signal is divided to obtain a measurement reference frequency $F_{OD}$ which is supplied to a frequency measurement circuit 3.

A quartz oscillator (XO) 4 for clock operation is designed to output an oscillation signal of a frequency $F_D$. Actually, however, its output frequency sometimes deviates from the design frequency $F_D$ due to various disturbances or manufacturing errors. Hereinafter, an actual output frequency of the quartz oscillator 4 is referred to as Fx. The actual frequency Fx is frequency-divided by a frequency divider 5 to obtain a clock reference frequency $F_{XD}$ which is supplied to the frequency measurement circuit 3 and a processor 6.

Receiving the measurement reference frequency $F_{OD}$ and the clock reference frequency $F_{XD}$, the frequency measurement circuit 3 measures the clock reference frequency $F_{XD}$ using the measurement reference frequency $F_{OD}$ and outputs a frequency measurement value (Fx) of the actual frequency Fx to the processor 6. As well-known, the frequency measurement circuit 3 is typically comprised of a frequency counter. The processor 6, as described below, calculates a deviation D of the actual clock reference frequency $F_{XD}$ from the design value $F_D$ and then calculates a correction time interval 1/D during which the clock gains or loses a unit of time, for instance, one (1) second. If the deviation D is positive, the clock gains, and if negative, the clock loses. The correction time interval 1/D is stored in a non-volatile RAM (random access memory) 7.

The processor 6 performs the normal clock operation based on the actual clock reference frequency $F_{XD}$ as well as the time correction at intervals of 1/D which is stored in the non-volatile RAM 7. A time display circuit 8 displays hours, minutes and seconds under control of the processor 6.

Figure 2:
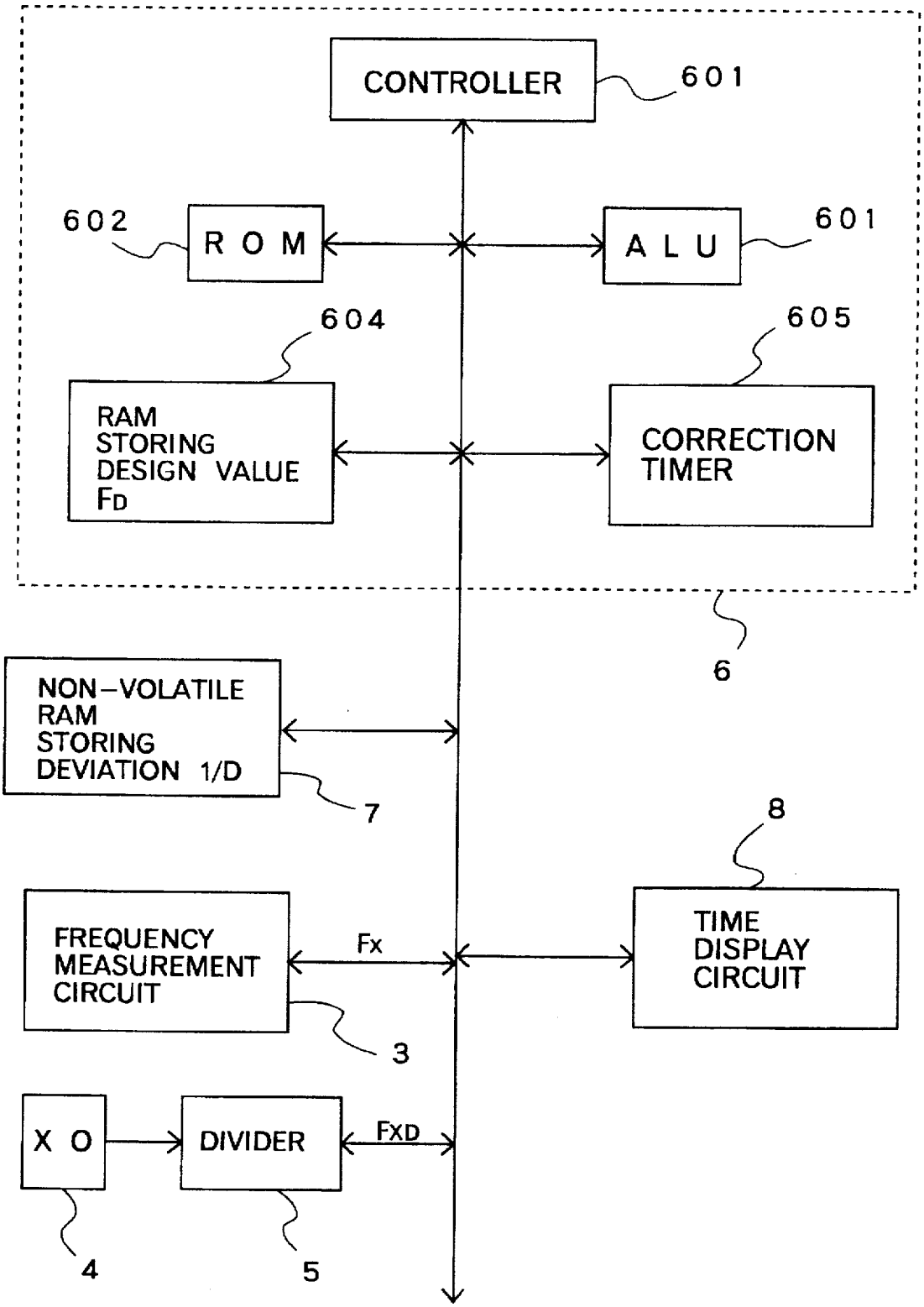
FIG. 2 is a block diagram showing a detailed circuit configuration of a processor in the embodiment.

Referring to FIG. 2, the processor 6 is comprised of a controller 601, a ROM (read only memory) 602 storing a clock operation program and a time correction program, an arithmetic logic unit (ALU) 603, a RAM 604 storing the design value $F_D$, a correction timer 605, and other necessary components (not shown). The design value $F_D$ is previously stored in the RAM 604. The correction timer 6 is used to measure the correction time interval 1/D. The calculation of the correction time interval 1/D and the time correction procedure will be described in detail.

Calculation of correction time interval 1/D

Assuming that the output frequency Fo of the TCXO 1 is 14.4 MHz, the divider 2 causes the frequency Fo to be divided by three (3), the design frequency $F_D$ of the quartz oscillator 4 is 32.768 KHz, and the divider 5 causes the actual frequency Fx to be divided by sixteen (16). Therefore, the measurement reference frequency $F_{OD}$ equal to 4.8 MHz is obtained by the divider 2 and the clock reference frequency $F_{XD}$ equal to 2048 Hz is obtained by the divider 5 if the actual frequency Fx is equal to 32.768 KHz. The clock reference frequency $F_{XD}$ equal to 2048 Hz causes the clock to operate accurately.

The frequency measurement circuit 3 measures the actual clock reference frequency $F_{XD}$ which is actually generated by the quartz oscillator 4 by using the measurement reference frequency $F_{OD}$=4.8 MHz. Here, it is assumed that a frequency measurement value (Fx) is equal to 32.76833 KHz.

The processor 6 subsequently calculates the frequency deviation D by using the design frequency $F_D$=32.768 KHz in accordance with the following equation:

$$D=(Fx)/F_D-1.$$

Here, since (Fx)=32.76833 KHz and $F_D$=32.768 KHz, the deviation D is approximately equal to $1\times10^{-5}$ which is positive. This means that the clock gains one second every $1/D=1\times10^5$ (seconds)=1667 (minutes). Therefore, time correction to set the clock one second later may be carried out once every 1667 minutes. The processor 6 writes the correction time interval of 1/D (here 1667 minutes) onto the non-volatile RAM 7. When the correction time interval is too long to deal with, such a calculation may be carried out predetermined number of hours or days. The processor 6 then performs the time correction of the clock on the basis of the correction time interval 1/D stored in the non-volatile RAM 7, as described hereinafter.

Time correction

It is assumed that the correction time interval of 1667 (minutes) is stored in the non-volatile RAM 7. In addition, it is supposed that the clock is set only one second later or earlier every 1667 minutes which is measured by the correction timer 605. Further, a 30-second time point in every minute is determined as the time correction timing in order not to change numerals indicating minutes. The time may be corrected at a time point before a 30-second lapse and after a one-second lapse in every minute. Hereinafter, Tsec represents numerals indicating seconds.

Figure 3:
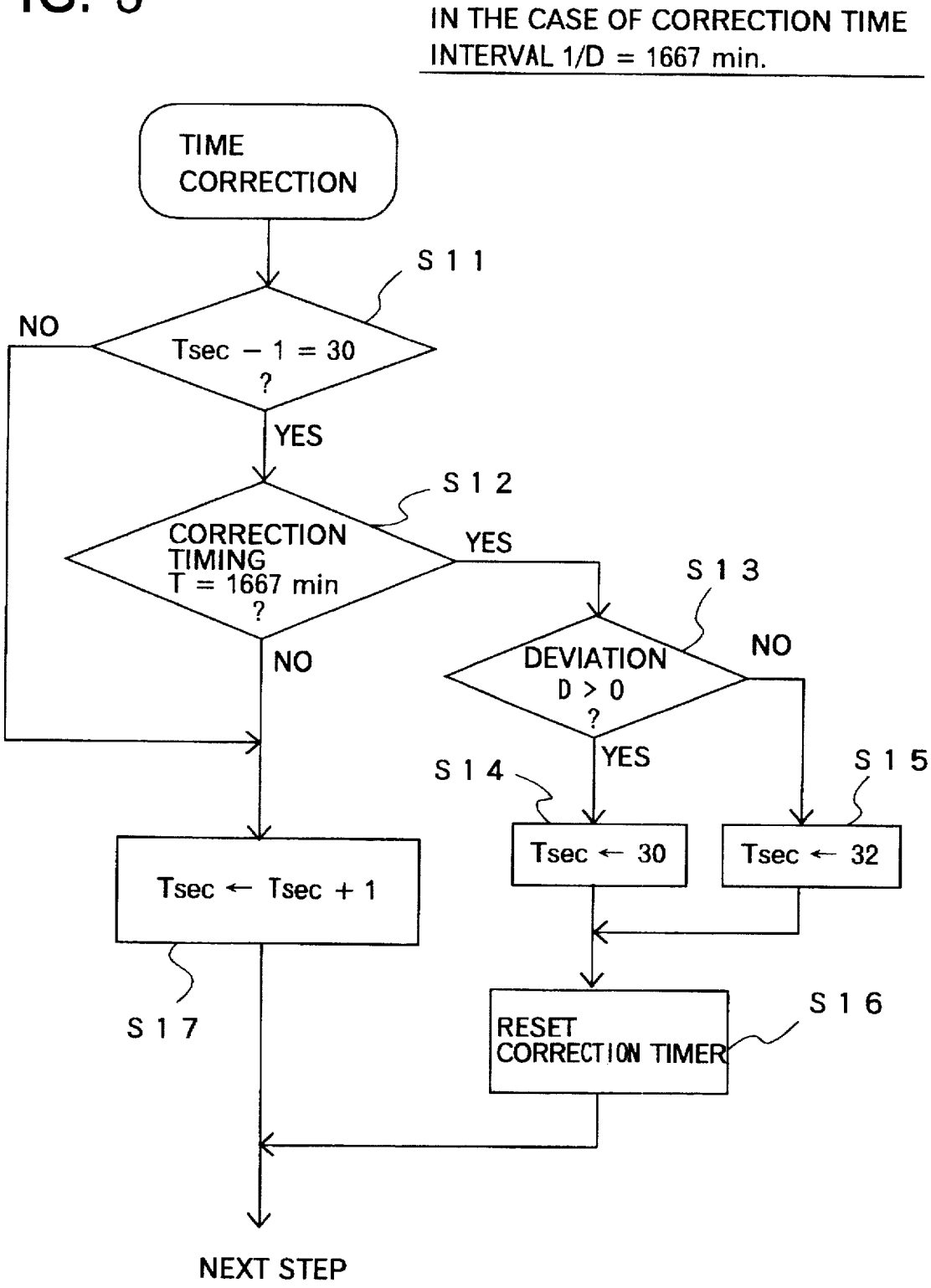
FIG. 3 is a flowchart showing an embodiment of a time correction method according to the present invention.

As shown in FIG. 3, a decision is first made as to whether Tsec is equal to thirty-one (31) or not, in other words, a time point which is one second before Tsec is a 30-second time point or not (S11). If Tsec−1=30, it is decided whether the current time point is the timing of correction or not (S12). In other words, a decision is made as to whether the correction timer 605 has reached the set value of the correction time interval (1667 minutes) which is stored in the non-volatile RAM 7.

When the correction timer 605 reaches 1667 minutes (Yes in S12), it is decided whether the deviation D is positive or negative, i.e., the clock gains or loses (S13). If the deviation D is positive, the value of 30 seconds is substituted into Tsec to set the clock later (S14). On the other hand, if negative, the value of 32 seconds is substituted into Tsec to set the clock earlier (S15). In this way, the time correction is carried out and the control proceeds to the next step after resetting the correction timer 605 (S16).

When Tsec is not equal to thirty-one (31) at the step S11, Tsec is increased by one second (S17) for normal clock operation before the control proceeds to the next step. The same operation is performed when the time is judged to be at no correction timing at the step S12.

Figure 4:
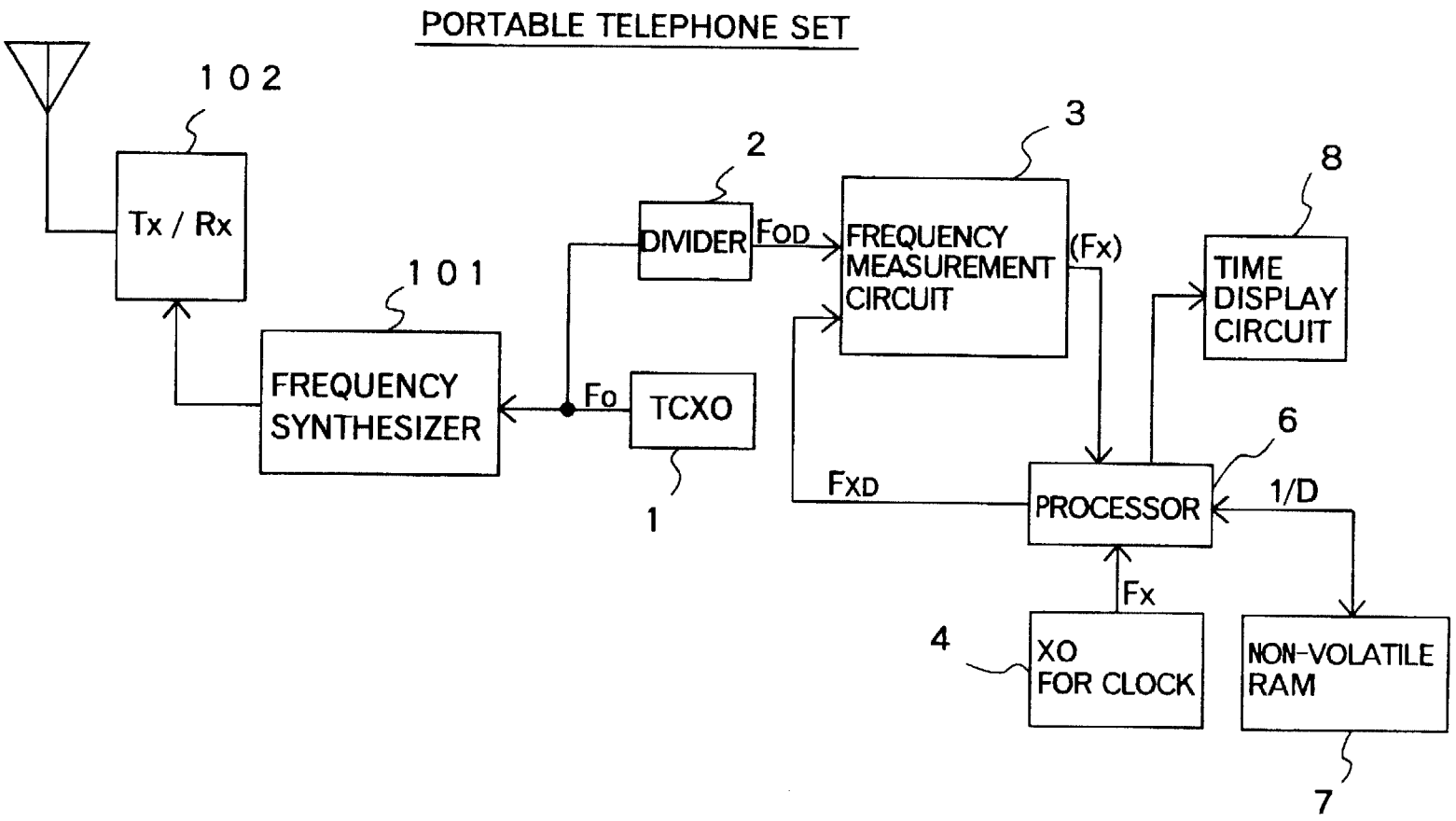
FIG. 4 is a schematic block diagram showing a portable telephone adopting an electronic clock according to the present invention.

Referring to FIG. 4 which shows a portable telephone set employing the electronic clock according to the present invention, the portable telephone set is usually provided with a frequency synthesizer 101 for generating oscillation frequencies for use in transmitter/receiver 102. A reference frequency is generated by the TCXO 1 and is supplied to the frequency synthesizer 101. In the portable telephone shown in FIG. 4, the reference frequency is used as the frequency Fo required in the electronic clock according to the present invention.

The processor 6 receives the actual oscillation frequency $F_X$ from the quartz oscillator (XO) 4 to output the clock reference frequency $F_{XD}$ which is used to perform the clock operation. The clock reference frequency $F_{XD}$ is also output to the frequency measurement circuit 3 where the measurement value (Fx) of the actual oscillation frequency $F_X$ is obtained using the measurement reference frequency $F_{OD}$. Receiving the measurement value (Fx), the processor 6 calculates the correction time interval 1/D as described above and subsequently stores it into the non-volatile RAM 7. As shown in FIG. 3, the correction time interval 1/D is read out of the non-volatile RAM 7 at the correction timing to carry out the time correction of the clock display circuit 8 (Steps S12–S15 in FIG. 3).

Since the TCXO 1 of the portable telephone usually operates only when the power supply is turned on, the correction time interval 1/D is calculated when the power supply is turned on and is stored in the non-volatile RAM 7. With this operation, the time correction can be effected based on the correction time interval 1/D stored in the non-volatile RAM 7 by means of the processor 6 when the power supply is turned off.

As described above, the electronic clock according to the present invention is comprised of two oscillators: one generating a first frequency for clock operation and the other generating a second frequency which is more accurate than the first frequency. Accordingly, there can be obtained a highly accurate electronic clock by a simple construction without using any special device. For example, when the TCXO incorporated in a radio device is used as a reference frequency generating source, the high accuracy whose monthly deviation is approximately ±3 seconds can be achieved.

While this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is, therefore, contemplated that the appended claims will cover any such modifications or embodiments as fall within the true scope of the invention.

I claim:

1. An electronic clock incorporated in a portable radio communication apparatus, the electronic clock comprising:

first means for generating a first oscillation signal having a first frequency, the electronic clock operating based on the first oscillation signal;

second means for generating a second oscillation signal having a second frequency, which is for producing reference frequencies for radio communication, the second means being more accurate in frequency than the first means, wherein said second means comprises a temperature-compensated quartz oscillator (TCXO);

detection means for detecting a deviation of the first frequency from a predetermined frequency using the second frequency as a reference frequency;

storage means for storing the deviation;

display means for displaying at least hours, minutes, and seconds;

means for determining a current time point of said electronic clock; and correction means for correcting time of the electronic clock, based on the deviation, at a single, predetermined time point of said electronic clock representing a correction timing point.

2. The electronic clock according to claim 1, wherein the storage means comprises a non-volatile memory.

3. The electronic clock according to claim 1, wherein the detection means comprises:

frequency measuring means for measuring the first frequency using the second frequency as the reference frequency; and deviation calculation means for calculating the deviation using the first frequency and the predetermined frequency.

4. The electronic clock according to claim 1, wherein the correction means comprises:

time interval calculation means for calculating a correction time interval from the deviation, a predetermined time departure being generated during the correction time interval; and time correction means for correcting the time of the electronic clock by the predetermined time departure each time the correction time interval lapses.

5. The electronic clock according to claim 3, wherein the correction means comprises:

time interval calculation means for calculating a correction time interval from the deviation, a predetermined time departure being generated during the correction time interval; and time correction means for correcting the time of the electronic clock by the predetermined time departure each time the correction time interval lapses.

6. The electronic clock according to claim 1, wherein the detection means detects the deviation by subtracting one from a ratio of the first frequency to the predetermined frequency.

7. The electronic clock according to claim 3, wherein the deviation calculation means calculates the deviation by subtracting one from a ratio of the first frequency to the predetermined frequency.

8. The electronic clock according to claim 4, wherein the correction time interval is a reciprocal number of the deviation.

9. The electronic clock according to claim 5, wherein the correction time interval is a reciprocal number of the deviation.

10. The method according to claim 11, wherein the portable radio communication apparatus includes a local oscillator, and wherein said temperature-compensated quartz oscillator (TCXO) is for supplying the reference frequencies to the local oscillator included in the portable radio communication apparatus.

11. A method for correcting time of an electronic clock incorporated in a portable radio communication apparatus, the method comprising steps of:

a) generating a first oscillation signal having a first frequency, the electronic clock operating based on the first oscillation signal;

b) generating, by a temperature-compensated quartz oscillator (TCXO), a second oscillation signal having a second frequency which is for producing reference frequencies for radio communication, the second oscillation signal being more accurate in frequency than the first oscillation signal;

c) detecting a deviation of the first frequency from a predetermined frequency using the second frequency as a reference frequency;

d) storing the deviation in a memory;

e) determining a current time point of said electronic clock; and f) correcting time of the electronic clock, based on the deviation, at a single, predetermined time point of said electronic clock representing a correction timing point.

12. The method according to claim 11, wherein the memory comprises a non-volatile memory.

13. The method according to claim 11, wherein the step (c) comprises:

measuring the first frequency using the second frequency as the reference frequency; and calculating the deviation using the first frequency and the predetermined frequency.

14. The method according to claim 11, wherein the step (d) comprises:

calculating a correction time interval from the deviation, a predetermined time departure being generated during the correction time interval; and correcting the time of the electronic clock by the predetermined time departure each time the correction time interval lapses.

15. The method according to claim 13, wherein the step (d) comprises:

calculating a correction time interval from the deviation, a predetermined time departure being generated during the correction time interval; and correcting the time of the electronic clock by the predetermined time departure each time the correction time interval lapses.

16. The method according to claim 11, wherein the deviation is detected by subtracting one from a ratio of the first frequency to the predetermined frequency.

17. The method according to claim 13, wherein the deviation is detected by subtracting one from a ratio of the first frequency to the predetermined frequency.

18. The method according to claim 14, wherein the correction time interval is a reciprocal number of the deviation.

19. The method according to claim 15, wherein the correction time interval is a reciprocal number of the deviation.

20. The method according to claim 11, wherein the predetermined frequency includes a design frequency which causes the electronic clock to operate accurately.

21. The electronic clock according to claim 1, wherein the portable radio communication apparatus includes a local oscillator, and wherein said temperature-compensated quartz oscillator (TCXO) is for supplying the reference frequencies to the local oscillator included in the portable radio communication apparatus.

* * * * *